US006935055B2

(12) United States Patent
Oorei

(10) Patent No.: US 6,935,055 B2
(45) Date of Patent: Aug. 30, 2005

(54) SOLE STRUCTURE FOR A CLEATED SHOE

(75) Inventor: Takeshi Oorei, Kobe (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/663,298

(22) Filed: Sep. 15, 2003

(65) Prior Publication Data

US 2004/0074111 A1 Apr. 22, 2004

(30) Foreign Application Priority Data

Sep. 20, 2002 (JP) ..... 2002-274510

(51) Int. Cl.[7] ..... A43B 5/00

(52) U.S. Cl. ..... 36/129; 36/134; 36/67 R; 36/25 R

(58) Field of Search ..... 36/129, 134, 59 R, 36/67 R, 25 R

(56) References Cited

U.S. PATENT DOCUMENTS 4,135,317 A * 1/1979 Ikeda ..... 36/134
4,361,971 A * 12/1982 Bowerman ..... 36/129
5,533,282 A * 7/1996 Kataoka et al. ..... 36/129
5,544,429 A * 8/1996 Ellis, III ..... 36/25 R
5,628,129 A * 5/1997 Kilgore et al. ..... 36/134
6,145,221 A * 11/2000 Hockerson ..... 36/126
2001/0039745 A1 * 11/2001 Nakano et al. ..... 36/25 R
2002/0092201 A1 * 7/2002 Kraeuter et al. ..... 36/25 R

* cited by examiner

*Primary Examiner*—M. D. Patterson
(74) *Attorney, Agent, or Firm*—W. F. Fasse; W. G. Fasse

(57) ABSTRACT

A track spiked shoe or a running shoe has a thin-plate-like outsole formed of a hard synthetic resin and having a plurality of cleats or studs on a ground contact surface thereof. The outsole has a first and second bulge each protruding downwardly toward the ground surface. The first bulge is located at a position that corresponds to a thenar eminence of a foot of a shoe wearer and the second bulge at a position that corresponds to a hypothenar eminence of a foot of a shoe wearer. The first and second bulge each has a configuration that conforms to a shape of a forefoot portion of a foot that has been flexed. Some of the cleats are provided on a convexly curved surface of the first and second bulge.

16 Claims, 6 Drawing Sheets

PRIOR ART

SOLE STRUCTURE FOR A CLEATED SHOE

BACKGROUND OF THE INVENTION

The present invention relates generally to a cleated shoe or a shoe having cleats in use for track and field, soccer, rugby, baseball, golf, or the like. More specifically, the present invention pertains to an improvement in a sole structure of a cleated shoe for the purpose of advanced traction performance due to an improved fittability between a sole and a plantar surface of a foot and also for the purpose of dispersion of thrust from the cleats.

In cleated shoes for track and field, various kinds of tightening means such as belts, shoelaces, or the like have been used in order to tightly fasten a shoe to a foot of a shoe wearer. In such shoes, a tightening means such as belts or shoelaces presses a foot of a shoe wearer via an upper of a shoe against an outsole.

An outsole of such cleated shoes is generally formed to conform to the shape of a foot in the longitudinal direction, but not in the transverse direction. However, especially, a forefoot portion of a foot also has an undulation in the transverse direction. Therefore, in a prior art shoe, even when fastening a tightening means, a plantar surface of a forefoot portion of a foot cannot be closely contacted with the outsole. Also, a region where a force is applied during running is not the whole plantar surface of a forefoot portion but a part of the plantar surface of the forefoot portion. Unless such a part of the plantar surface is closely contacted with the outsole, a slippage may occur between the plantar surface of a foot and the outsole of a shoe during running. Thereby, a gripping force of a foot relative to the ground through the outsole cannot be securely transmitted to the ground, which results in decrease in traction of a shoe.

A Japanese patent application laying-open publication No. 10-42904 discloses a shoe sole in use for bicycle races. This shoe sole has concave portions formed therein at positions that conform to a thenar and hypothenar eminence of a foot of a shoe wearer, respectively. The said publication describes that maintaining a thenar and hypothenar eminence of a foot in the corresponding concave portions of a shoe sole enables stepping force of a foot to instantly transmit to a pedal of a bicycle.

In a bicycle race, an athlete pushes a pedal by his or her entire foot without flexing the foot with a portion of a sole surface of a shoe contacted to the pedal. In contrast, in the case of track sports, an athlete must grip the ground surface securely at the time of striking onto the ground and advance forward by kicking the ground surface at the time of leaving the ground, which requires traction at the time of flexing of the forefoot portion of a foot.

Furthermore, in the case of track shoes, a strong thrust from the cleats during running acts upon a plantar surface of a foot. Therefore, in a prior-art cleated track shoe, an effective countermeasure is needed that can not only improve traction performance but also efficiently tolerate thrust from the cleats.

An object of the present invention is to provide a sole structure for a cleated shoe that can improve traction performance through the advanced fittability between a sole and a plantar surface of a foot and that can disperse thrust from cleats.

SUMMARY OF THE INVENTION

The present invention is directed to a sole structure for a cleated shoe or a shoe having cleats, spikes, or studs. This sole structure includes a thin-plate-like outsole formed of a hard material and having a plurality of cleats provided on a bottom surface of the outsole. The outsole has a first and second bulge, or convexly curved portion, which protrudes downwardly toward the ground surface. The first bulge is located at a position corresponding to a thenar eminence of a foot of a shoe wearer and the second bulge is located at a position corresponding to a hypothenar eminence of a foot of a shoe wearer. Each of the first and second bulge has a sectional shape conforming to a shape of a forefoot portion of a foot that has been flexed. Some of the cleats are provided on convexly curved surface of the first and second bulge.

According to the present invention, because the first and second bulge each has a sectional shape conforming to a shape of a forefoot portion of a foot that has been flexed, when the forefoot portion has been flexed during running the flexed forefoot portion can be closely contacted to a concave region of the first and second bulge, thereby enhancing fittability. As a result, a gripping force can be securely transmitted from a plantar surface of a foot to the ground at the time of flexing a forefoot portion, thereby improving traction performance of a shoe.

Furthermore, in this case, because some cleats are provided on a convexly curved surface of the first and second bulge, when a thrust from a cleat is exerted at the time of striking onto the ground the thrust can be radially (i.e. in every direction around the cleat) dispersed onto the convexly curved surface immediately around the cleat. To the contrary, in the case of cleats of a prior art sole structure, since the cleats were provided on a substantial flat surface of an outsole, a thrust from a cleat is directly exerted upwardly on the outsole, thereby exerting pressure on a plantar surface of a foot of a shoe wearer.

Here, the term "thenar eminence" indicates anatomically a metatarsophalangeal joint portion, or $MJ_1$ portion, of a first toe of a foot, as shown in FIG. 1. Similarly, the term "hypothenar eminence" indicates anatomically a metatarsophalangeal joint portion, or $MJ_5$ portion, of a fifth toe of a foot, as shown in FIG. 1.

A third bulge that protrudes downwardly toward the ground surface may be provided on the outsole at a position corresponding to a first distal phalanx of a foot of a shoe wearer. In this case, when kicking the ground the first toe can be closely contacted with a concavity of the third bulge, thereby enhancing fittability. As a result, a gripping force can be securely transmitted from the first toe to the ground surface when kicking the ground, thereby improving traction performance of a shoe.

Furthermore, in this case as well, because some cleats are provided on a convexly curved surface of the third bulge, when a thrust from a cleat is exerted at the time of striking onto the ground the thrust can be radially (i.e. in every direction around the cleat) dispersed onto the convexly curved surface immediately around the cleat.

A fourth bulge that protrudes downwardly toward the ground surface may be provided on the outsole at a region corresponding to each phalangeal joint between each distal phalanx and each middle phalanx of a second to fifth toe of a foot of a shoe wearer. In this case, when kicking the ground the second to fifth toe can be closely contacted with a concavity of the fourth bulge, thereby enhancing fittability. As a result, a gripping force can be securely transmitted from the second to fifth toe to the ground surface when kicking the ground, thereby improving traction performance of a shoe.

Furthermore, in this case as well, because some cleats are provided on a convexly curved surface of the fourth bulge, when a thrust from a cleat is exerted at the time of striking onto the ground the thrust can be radially (i.e. in every direction around the cleat) dispersed onto the convexly curved surface immediately around the cleat.

The outsole may have a flat, W-shaped cross section at the first and second bulges.

Preferably, one of the cleats is located at a top centered position of a corresponding bulge.

A midsole formed of a soft elastic material may be disposed at least at a forefoot portion of the upper surface of the outsole. In this case, when stepping onto the forefoot portion of the outsole, the midsole elastically deforms in accordance with the shape of a plantar surface of a foot. Thereby, an upper surface of the midsole can be made in a shape conforming to a shape of a forefoot portion of a foot irrespective of different shapes of each individual. As a result, at the time of stepping movement of a forefoot portion of a foot onto the outsole forefoot region, the forefoot portion of a foot can be closely contacted with the outsole via a midsole irrespective of different shapes of plantar surfaces, thereby further enhancing fittability. A gripping force can thus be securely transmitted from a foot to the ground surface and traction of a shoe improves. In this case, thrust from the cleats can be relieved by the midsole.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 2:
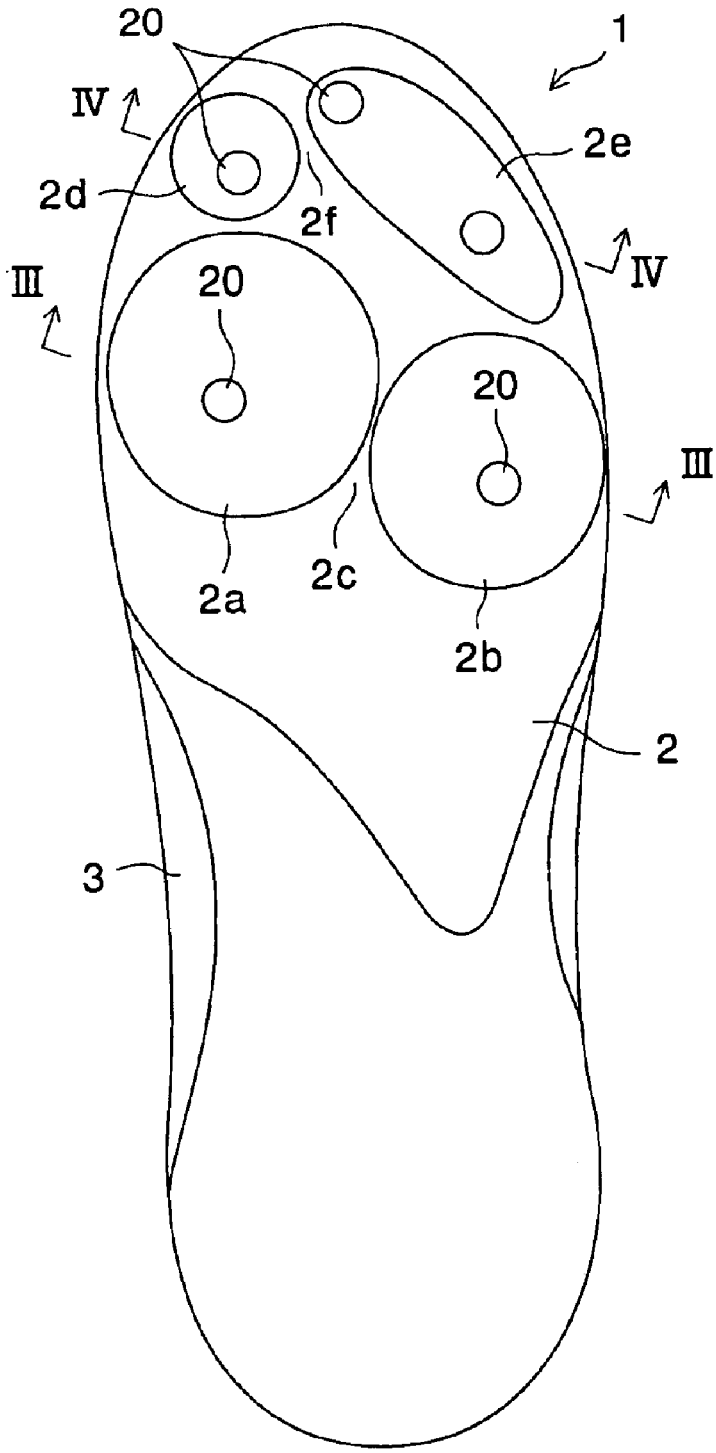
FIG. 2 is a bottom view of an outsole of a cleated track shoe employing a sole structure according to an embodiment of the present invention.

Referring now to the drawings, FIG. 2 shows a cleated track shoe 1 having an outsole 2 and an upper 3 attached on the outsole 2.

Figure 3:
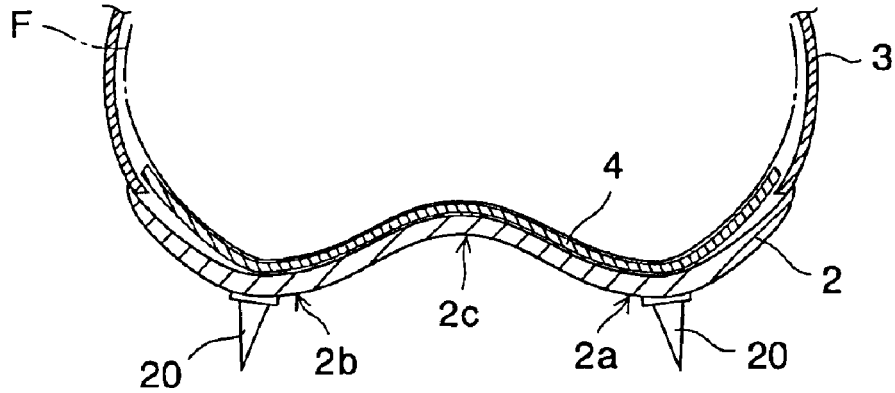
FIG. 3 is a cross sectional view of FIG. 2 taken along line III—III.

The outsole 2 is, as shown in FIG. 3, a thin plate member and may be formed of a hard synthetic resin. A plurality of cleats 20 are fitted on the bottom surface of the outsole 2. These cleats 20 may be formed of ceramic, metal, hard synthetic resin, or the like.

The forefoot portion of the outsole 2 is formed with a first bulge 2*a* and a second bulge 2*b*. Both of the bulges 2*a*, 2*b* protrude downwardly toward the ground surface, as shown in FIG. 3. Between the first and second bulges 2*a*, 2*b* may be formed a concavely curved portion 2*c* to smoothly connect these bulges 2*a* and 2*b*. Some of the cleats 20 are located on the convexly curved surfaces of the first and second bulges 2*a*, 2*b*. More preferably, one of the cleats 20 is located on a top centered position, i.e. the most protruded position, of a corresponding bulge 2*a*, 2*b*.

Figure 4:
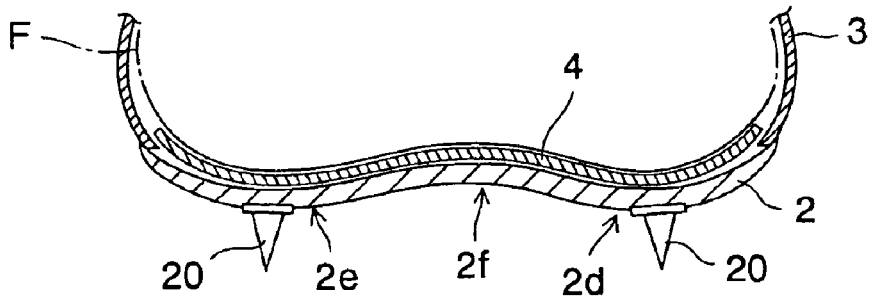
FIG. 4 is a cross sectional view of FIG. 2 taken along line IV–IV.

The forefoot portion of the outsole 2 further includes a third and fourth bulge 2*d*, 2*e* that are disposed in front of the first and second bulge 2*a*, 2*b*. Similarly, these bulges 2*d*, 2*e* protrude downwardly toward the ground surface, as shown in FIG. 4. A concavely curved portion 2*f* may be formed between the third and fourth bulges 2*d*, 2*e* to smoothly connect these bulges 2*d* and 2*e*. Some of the cleats 20 are located on the convexly curved surfaces of the third and fourth bulges 2*d*, 2*e*. More preferably, one of the cleats 20 is located on a top centered position, i.e. the most protruded position, of a corresponding bulge 2*d*, 2*e*.

Figure 1:
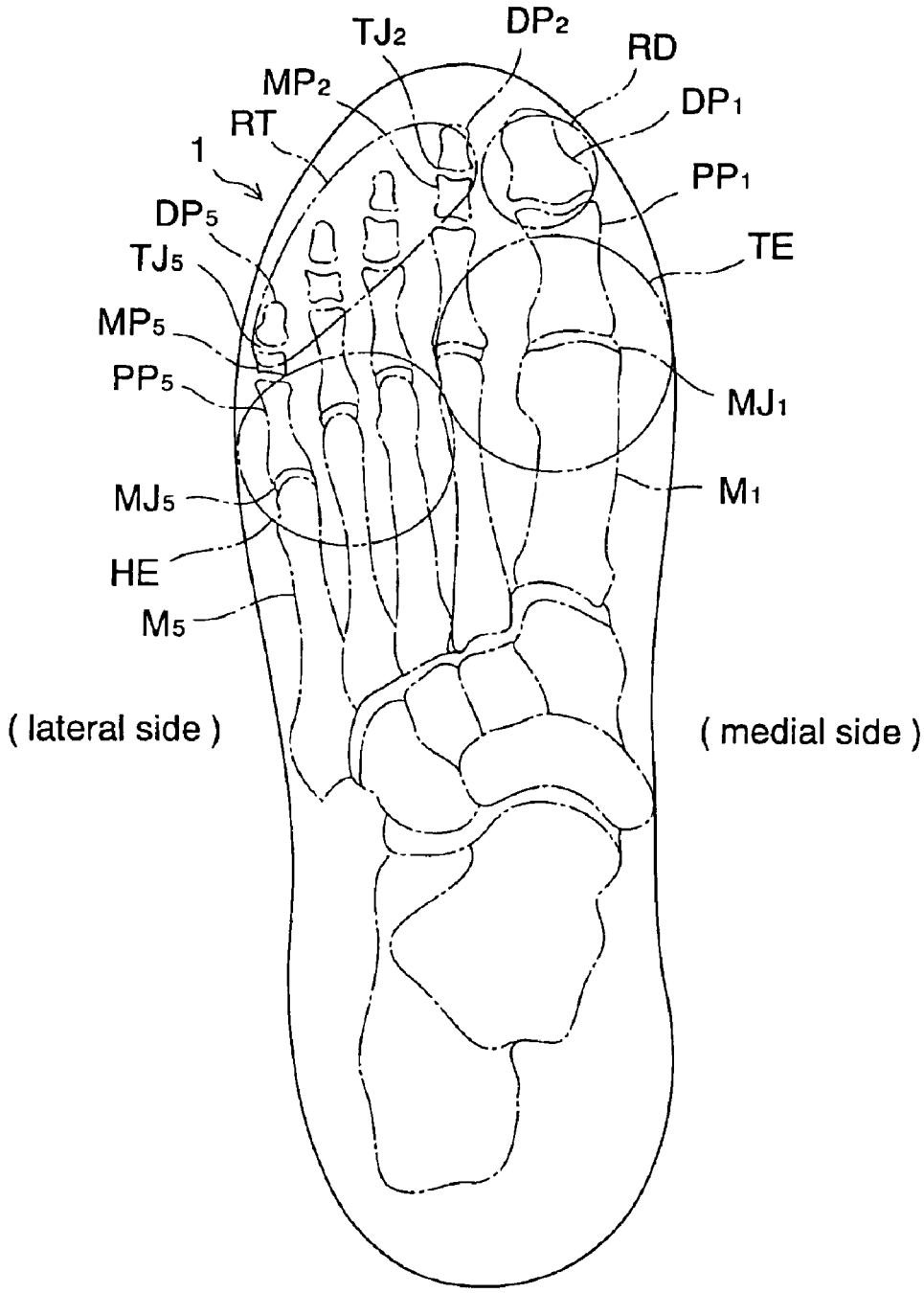
FIG. 1 illustrates each position of a first to fourth bulge along with a bone structure of a foot.

Here, in FIG. 1 showing a bone structure of a foot, a thenar eminence TE indicates anatomically a bulged, metatarsophalangeal joint portion $MJ_1$ and its perimeter disposed between a first proximal phalanx $PP_1$ and a first metatarsus $M_1$. Similarly, a hypothenar eminence HE indicates anatomically a bulged, metatarsophalangeal joint portion $MJ_5$ and its perimeter disposed between a fifth proximal phalanx $PP_5$ and a fifth metatarsus $M_5$. Also, a region RD encircled by a double dotted line indicates a region corresponding to a first distal phalanx $DP_1$. A region RT encircled by a double dotted line indicates a region including interphalangeal joints $TJ_2$ to $TJ_5$ between a second to fifth distal phalanx $DP_2$ to $DP_5$ and a second to fifth middle phalanx $MP_2$ to $MP_5$.

The aforementioned first bulge 2*a* is located at a position corresponding to the thenar eminence TE, and the aforementioned second bulge 2*b* is located at a position corresponding to the hypothenar eminence HE. Also, as shown in FIG. 3, each of the first and second bulges 2*a* and 2*b* has a curved concavity that conforms to the shape of a plantar surface of a forefoot portion F of a shoe wearer when the forefoot portion F has been flexed. The outsole 2 has a flat, W-shaped cross section at the first and second bulges 2*a*, 2*b*. In FIG. 3, an insole 4 is also provided on the upper surface of the outsole 2. The insole 4 has a curved shape conforming to the shape of the outsole 2.

The third bulge 2*d* is located at a position corresponding to the region RD, and the fourth bulge 2*e* is located at a position corresponding to the region RT. Also, as shown FIG. 4, each of the third and fourth bulges 2*d* and 2*e* has a curved concavity that conforms to the shape of a bottom surface of a toe portion of a shoe wearer. Similarly, in FIG. 4, an insole 4 is also provided on the upper surface of the outsole 2, and the insole 4 has a curved shape conforming to the shape of the outsole 2.

In this case, because the first and second bulge 2*a*, 2*b* on the outsole 2 has a configuration conforming to the shape of the flexed forefoot portion F, when the forefoot portion F has been flexed during running the thenar eminence TE and the hypothenar eminence HE of the forefoot portion F closely contact the concavities of the first and second bulges 2*a*, 2*b*, thereby improving fittability of the outsole 2 relative to the foot.

As a result, when the forefoot portion F flexes at the time of stepping and kicking during running, a gripping force can be securely transmitted from the foot to the ground surface, thereby enhancing traction of the outsole.

Furthermore, in this case, because the third bulge 2*d* is located at a position corresponding to a first distal phalanx and the fourth bulge 2*e* is located at a region including interphalangeal joints between a second to fifth distal phalanx and a second to fifth middle phalanx, when the forefoot portion F flexes during running the toes closely contact concavities of the third and fourth bulges 2*d*, 2*e*. Thereby, fittability of the outsole 2 relative to the foot further improves.

As a result, when the forefoot portion F flexes at the time of stepping onto and kicking the ground during running, a gripping force can be more securely transmitted from the foot to the ground surface, thereby further enhancing traction of the outsole.

Figure 5:
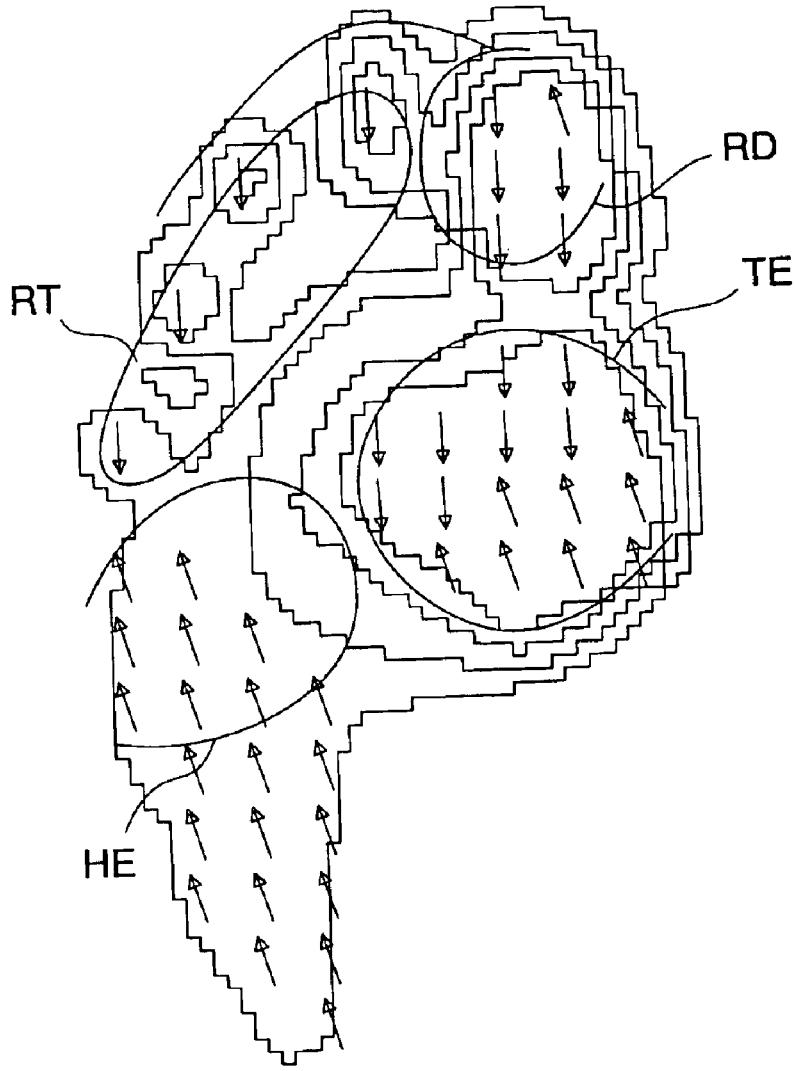
FIG. 5 illustrates a tractional force distribution diagram along with a sole pressure distribution diagram on the outsole.

Next, FIG. 5 shows a sole pressure and tractional force distribution diagram, where a sole pressure is exerted on a plantar surface of a forefoot portion of a foot and tractional force is applied from the forefoot portion to the ground surface. In the drawing, constant-pressure lines indicate sole pressures. Also, an arrow mark in the downward direction shows the direction of the tractional force at the time of stepping onto and kicking the ground, and an arrow mark in the upward direction shows the direction of the tractional force at the time of striking onto the ground.

As shown in FIG. 5, the sole pressure is relatively high at positions corresponding to the thenar eminence TE and region RD, RT. Also, at the time of stepping and kicking, the tractional force is applied to the ground surface from the positions corresponding to the thenar eminence TE and regions RD, RT. At the time of impacting onto the ground, the tractional force is applied to the ground from the position corresponding to the hypothenar eminence HE.

Therefore, by providing the outsole with the first to fourth bulge to enhance fittability of the outsole relative to a plantar surface of a forefoot portion of a foot, a tractional force can be effectively exerted onto the ground surface not only at the time of stepping onto and kicking the ground but also at the time of striking onto the ground.

Figure 6:
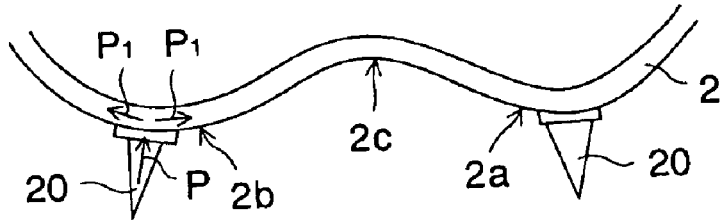
FIG. 6 is a schematic illustrating one of the effects of the preferred embodiment of the present invention.

Moreover, since the cleats 20 are provided on the convexly curved surface of the first and second bulge 2*a*, 2*b*, when an upward thrust P is applied from a cleat 20 at the time of contacting the ground, as shown in FIG. 6, thrust P is resolved into a multiple components $P_1$ along the convexly curved surface around the cleat 20 and dispersed radially (i.e. in every direction around the cleat 20). Thereby, thrust from a cleat 20 can be effectively dispersed.

To the contrary, in a prior art shoe having cleats on a substantially flat surface of an outsole, thrust of the cleats directly acts on the outsole in the upward direction and exerts pressure on a plantar surface of a foot.

In addition, since cleats 20 are also provided on the convexly curved surfaces of the third and fourth bulges 2*d*, 2*e*, thrust of these cleats 20 can be dispersed on these convexly curved surfaces as well. However, in this case, a curvature of each of the convexly curved surfaces of the third and fourth bulges 2*d*, 2*e* is relatively small, thrust-dispersing effect is greater in the case of the first and second bulges 2*a*, 2*b*.

Generally, as the load exerted on a plantar surface of a foot becomes greater, deformation of a foot, a thrust from a cleat and traction relative to the ground surface also become greater. Therefore, in track sports such as a dash where an extremely great load is exerted, a curvature of protrusion of a bulge is made relatively large. On the other hand, in track sports such as a long-distance race where an extremely great load is hardly ever exerted, a curvature or protrusion of a bulge is made relatively small. Also, if a curvature or protrusion of a bulge where a greater load is exerted in a race is made greater according to the kinds of races or athletes, more effective traction control and thrust dispersion control can be achieved.

Figure 7:
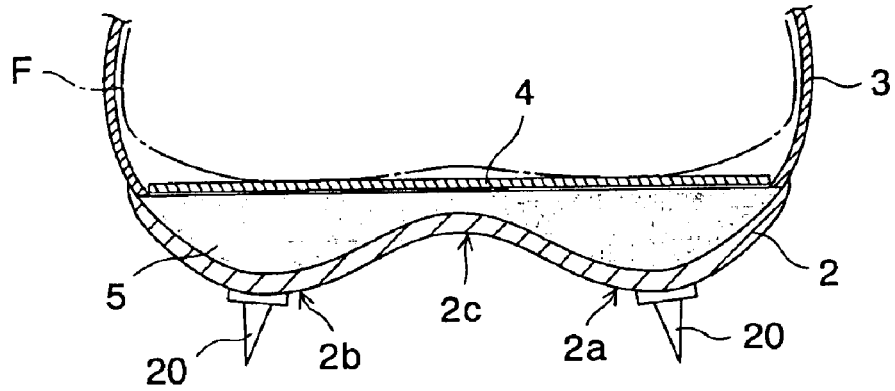
FIG. 7 is a cross sectional view of a cleated track shoe employing a sole structure according to another embodiment of the present invention.
Figure 8:
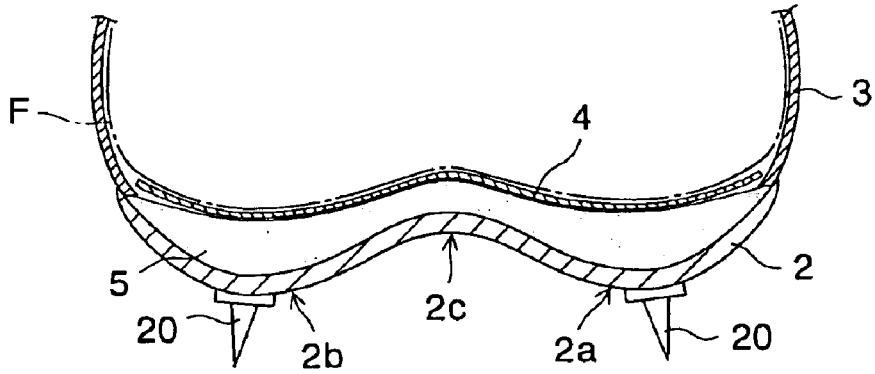
FIG. 8 is a schematic illustrating one of the effects of the embodiment shown in FIG. 7.

FIGS. 7 and 8 illustrate an alternative embodiment of the present invention. In these drawings, like reference numbers indicate identical or functionally similar elements.

In this alternative embodiment, as shown in FIG. 7, a midsole 5 formed of a soft elastic material is interposed between an insole 4 and an outsole 2. As a material forming the midsole 5, foamed thermoplastic resin such as ethylene-vinyl acetate copolymer (EVA), foamed thermosetting resin such as polyurethane (PU), and foamed rubber such as butadiene rubber or chloroprene rubber may be used. The bottom surface of the midsole 5 has an undulation corresponding to the shape of each bulge 2*a*, 2*b* of the outsole 2. The upper surface of the midsole 5 has a substantially flat surface. The insole 4 is a substantially flat member extending along the upper surface of the midsole 5.

In this case, when a forefoot portion F steps on the insole 4, as shown in FIG. 8, the midsole 5 deforms elastically along with the insole 4 in accordance with an undulation of a plantar surface of the forefoot portion F and an undulation of the first and second bulge 2*a*, 2*b* of the outsole 2. Thereby, an upper surface, or a foot contact surface, of the midsole 5 can be made in a shape conforming to an undulation of the forefoot portion F of a foot.

In such a manner, at the time of stepping, the forefoot portion F can be closely contacted with the outsole 2 through the midsole 5, thereby enhancing fittability regardless of differences of plantar surfaces of each individual. As a result, a gripping force can be securely transmitted from a foot to the ground surface, thus improving traction performance as a shoe at the time of stepping and kicking. Moreover, in this case, thrust of the cleats 20 can be also relieved by the midsole 5.

Figure 9:
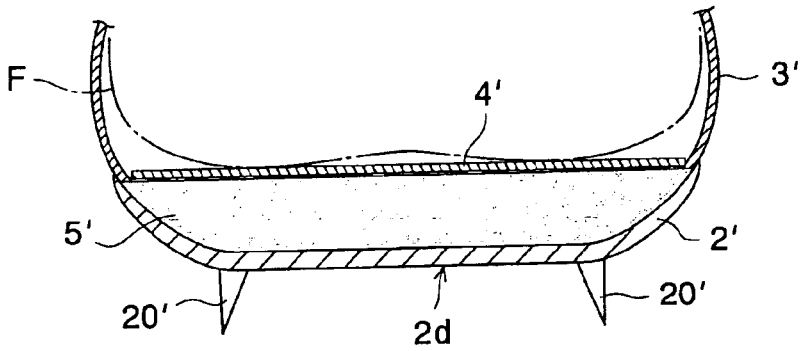
FIG. 9 is a cross sectional view of a cleated track shoe of prior art.
Figure 10:
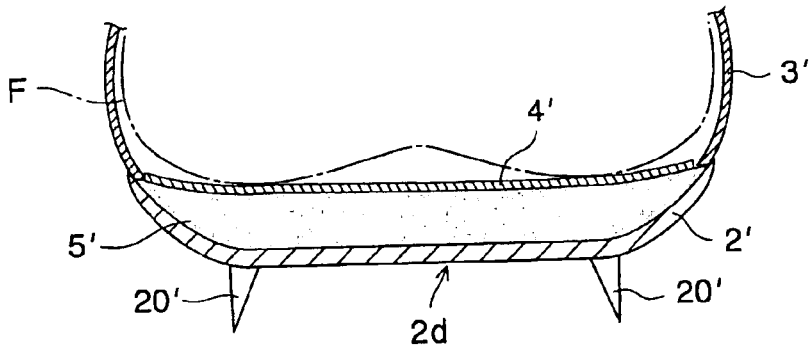
PRIOR ART FIG. 10
FIG. 10 is a schematic illustrating a shoe of FIG. 9 in use, which is a comparative example of FIG. 8.

Next, as a comparative example, a prior art sole structure is shown in FIGS. 9 and 10. In these drawings, like reference numbers indicate identical or functionally similar elements to those of the embodiments of the present invention.

As shown in FIG. 9, an outsole 2' of the prior art sole structure has a flat portion 2*d* at a bottom thereof. In this case, when a forefoot portion F steps on an insole 4' and a downward load is applied to the forefoot portion F, as shown in FIG. 10, each portion of the midsole 5 compressively deforms in an equal manner. As a result of this, an upper surface or a foot contact surface of the midsole 5 cannot be closely contacted to an undulation of the forefoot portion F of afoot. There exists a clearance between a plantar surface of a foot and the insole 4'. Therefore, in a prior art sole structure, there was a case where a gripping force could not be securely transmitted from a foot to the ground surface.

In contrast, according to the present invention, since the forefoot portion F of a foot can be closely contacted to an upper surface of an outsole 2 via an insole 4 and/or a midsole 5, a gripping force can be securely transmitted from the foot to the ground surface, thereby advancing a traction performance.

In the above-mentioned embodiment and alternative embodiment, a cleated track shoe was shown as a preferred example of the present invention, but the sole structure of the present invention is also applicable to a cleated shoe for soccer, rugby, baseball, golf, or the like.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A sole structure for a cleated shoe adapted to be worn on a foot of a person, said sole structure comprising:

an outsole formed of a thin plate of a hard material; and a plurality of cleats provided on a lower surface of said outsole;

wherein said outsole has a first bulge and a second bulge that each respectively include a convex bulge protrusion protruding downwardly on said lower surface of said outsole and a concave bulge depression on an upper surface of said outsole in correspondence with said convex bulge protrusion on said lower surface, said first bulge is located at a first position adapted to correspond to a thenar eminence of the foot of the person, said second bulge is located at a second position adapted to correspond to a hypothenar eminence of the foot of the person, said concave bulge depressions of said first and second bulges have a sectional shape adapted to conform to a shape of a forefoot portion of the foot that has been flexed, and at least some of said cleats are provided on convexly curved surfaces of said convex bulge protrusions of said first and second bulges.

2. The sole structure for a cleated shoe according to claim 1, wherein said outsole further includes a third bulge protruding downwardly, said third bulge is located at a third position adapted to correspond to a first distal phalanx of the foot of the person, and at least some of said cleats are provided on a convexly curved surface of said third bulge.

3. The sole structure for a cleated shoe according to claim 2, wherein one of said cleats is located at a centered position of one of said bulges.

4. The sole structure for a cleated shoe according to claim 2, wherein said sole structure further includes a midsole formed of a soft elastic material, said midsole disposed at least at a forefoot portion of the upper surface of said outsole.

5. The sole structure for a cleated shoe according to claim 2, wherein said outsole further includes a fourth bulge protruding downwardly, said fourth bulge is located at a region adapted to correspond to each phalangeal joint between each distal phalanx and each middle phalanx of a second toe to a fifth toe of the foot of the person, and at least some of said cleats are provided on a convexly curved surface of said fourth bulge.

6. The sole structure for a cleated shoe according to claim 5, wherein one of said cleats is located at a centered position of one of said bulges.

7. The sole structure for a cleated shoe according to claim 5, wherein said sole structure further includes a midsole formed of a soft elastic material, said midsole disposed at least at a forefoot portion of the upper surface of said outsole.

8. The sole structure for a cleated shoe according to claim 1, wherein said outsole has a flat, W-shaped undulating cross section at said first and second bulges.

9. The sole structure for a cleated shoe according to claim 8, wherein one of said cleats is located at a centered position of one of said bulges.

10. The sole structure for a cleated shoe according to claim 8, wherein said sole structure further includes a midsole formed of a soft elastic material, said midsole disposed at least at a forefoot portion of the upper surface of said outsole.

11. The sole structure for a cleated shoe according to claim 1, wherein one of said cleats is located at a centered position of one of said bulges.

12. The sole structure for a cleated shoe according to claim 11, wherein said sole structure further includes a midsole formed of a soft elastic material, said midsole disposed at least at a forefoot portion of the upper surface of said outsole.

13. The sole structure for a cleated shoe according to claim 1, wherein said sole structure further includes a midsole formed of a soft elastic material, said midsole disposed at least at a forefoot portion of the upper surface of said outsole.

14. The sole structure for a cleated shoe according to claim 13, wherein said midsole in an uncompressed condition has a flat upper surface and an undulating curved lower surface fitting said concave bulge depressions on said upper surface of said outsole.

15. The sole structure for a cleated shoe according to claim 1, wherein said bulges give said lower surface a smoothly curved undulating sectional shape.

16. The sole structure for a cleated shoe according to claim 1, wherein said thin plate forming said outsole has a continuous uniform thickness in an area of said bulges.

* * * * *